US006807693B2

(12) United States Patent
Grossman

(10) Patent No.: US 6,807,693 B2
(45) Date of Patent: Oct. 26, 2004

(54) MULTI-ANGLE HOOK

(75) Inventor: Joel Grossman, Selangor (MY)

(73) Assignee: Grossman Project Services Sdn. Bhd., Kuala Lumpur (MY)

( * ) Notice: Subject to any disclaimer, the term of this patent is extended or adjusted under 35 U.S.C. 154(b) by 183 days.

(21) Appl. No.: 09/761,108

(22) Filed: Jan. 17, 2001

(65) Prior Publication Data

US 2002/0092093 A1 Jul. 18, 2002

(51) Int. Cl.[7] ..... A47C 17/04
(52) U.S. Cl. ..... 5/37.1; 5/12.1; 5/47
(58) Field of Search ..... 5/37.1, 12.1, 47, 5/41, 42, 39, 48; 297/354.13

(56) References Cited

U.S. PATENT DOCUMENTS 4,875,244 A * 10/1989 Tremblay ..... 5/37.1
5,519,902 A * 5/1996 Meade ..... 297/354.13
5,709,500 A * 1/1998 Mizelle et al. ..... 16/386
6,108,833 A * 8/2000 Grossman et al. ..... 5/12.1

* cited by examiner

*Primary Examiner*—Teri Pham Luu
*Assistant Examiner*—Fredrick Conley
(74) *Attorney, Agent, or Firm*—Harness, Dickey & Pierce, P.L.C.

(57) ABSTRACT

A multi-angle hook fastened to an extension member, that is used to stop the extension from completely pulling out of the frame it sits in. When fully extended, the multi-angle hook allows at least three different holding positions, seen as three different angles that the extension sits at while using the multi-angle hook as its fixed point of pivot. The multi-angle hook is a metal, plastic, or wood plate bent along several parallel lines, across its width, at varying angles.

36 Claims, 9 Drawing Sheets

Lounger Position

Steamer Position

Bed Position

MULTI-ANGLE HOOK

FIELD OF THE INVENTION

The present invention is generally directed to a multi-angle hook, and more particularly, to a multi-angle hook for use with a furniture extension.

BACKGROUND

Description of the Related Art

Futon frames come in one of at least two different configurations, bi-fold, and tri-fold. In a bi-fold configuration illustrated in FIG. 1, a convertible futon sofa-bed frame allows the futon mattress to fold once along its length. Typically, bi-fold configurations are utilized for larger width furniture, such as sofas, so that one or more persons may lie on the futon sofa-bed frame, with the orientation illustrated in FIG. 2.

The tri-fold configuration, illustrated in FIG. 3, is more commonly utilized for narrower futon frames (for example a 28" wide chair or 54" wide loveseat). In a tri-fold, the futon mattress is folded twice along its usually shorter width. A futon mattress may hang over the back of the frame or be folded under the seat itself, or lay flat as a chaise lounge style seat. A person lies on the tri-fold in the orientation illustrated in FIG. 4.

An extension 10 may be added to the seat platform 12 of a futon frame to form a leg-rest (as an ottoman) as well as giving extra length to smaller size futon frames to allow the user to form the full length bed illustrated in FIG. 4.

The extension 10 may be a framed platform including outer frame members and inside slat components. The slats of the extension 10 commonly "nest" into the slats of the seat platform 12; in other words, the extension slats slide in between the slats of the seat platform 12, sliding in and out in relation to them.

The extension 10 may be fastened to the seat in various ways but most commonly there is a bar of wood or metal on the underside of (and at the rear of) the extension slats which holds the extension slats together as fixed group. This bar also serves to stop the extension 10 from being pulled completely out of the seat platform 12. The bar is below the slats and stops firmly against the frame of the seat platform 12 keeping the extension 10 from pulling out completely. This bar is permanently fixed to the extension 10 and makes removal of the extension 10 from the rest of the frame impossible.

SUMMARY OF THE INVENTION

The present invention changes the nature of the attachment of the extension to the seat platform by allowing easy and complete removal of the extension from the seat platform.

The present invention utilizes a multi-angle hook that allows the extension platform to be freely lifted off the seat platform and alternately lowered and set into place.

This flexibility is advantageous in the following ways:

1) conversion of the futon frame into its various positions (bed, recliner, and upright-sofa) is easier to do as the frame is easier to manipulate with the extension removed;

2) defective parts are easily replaced; and/or 3) parts management in manufacturing is simpler thereby saving production cost.

Additionally, the multi-angle hook is stepped at its holding points to allow for at least two positions most extensions require:

1) Horizontal: flat for straight-legged position, such as a bed position; and 2) angled to the floor: a "steamer" position.

DETAILED DESCRIPTION OF THE PREFERRED EMBODIMENTS

Figure 1:
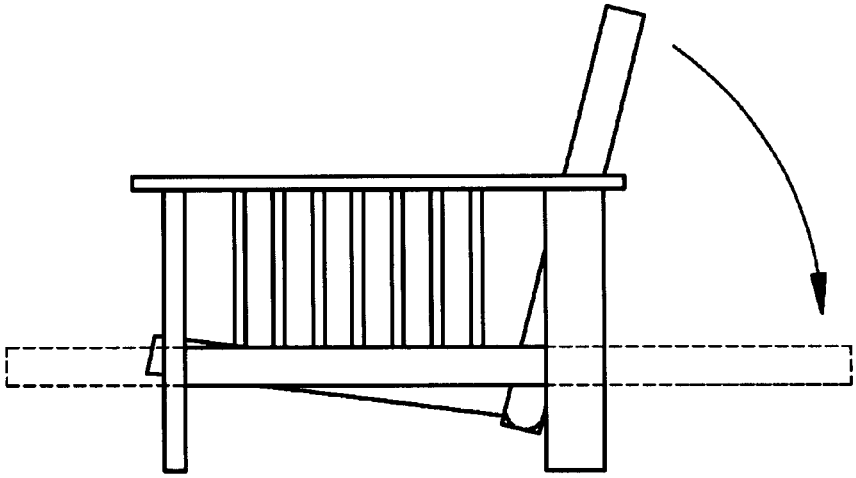
FIG. 1 illustrates a conventional bi-fold configuration.
Figure 3:
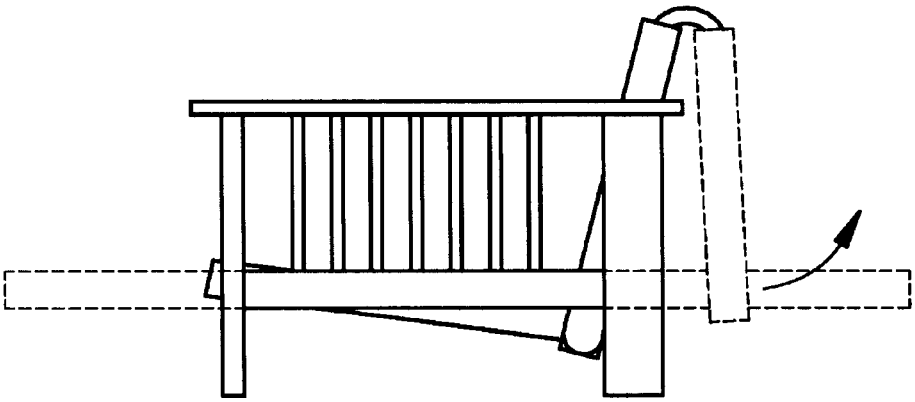
FIG. 3 illustrates a conventional tri-fold configuration.
Figure 2:
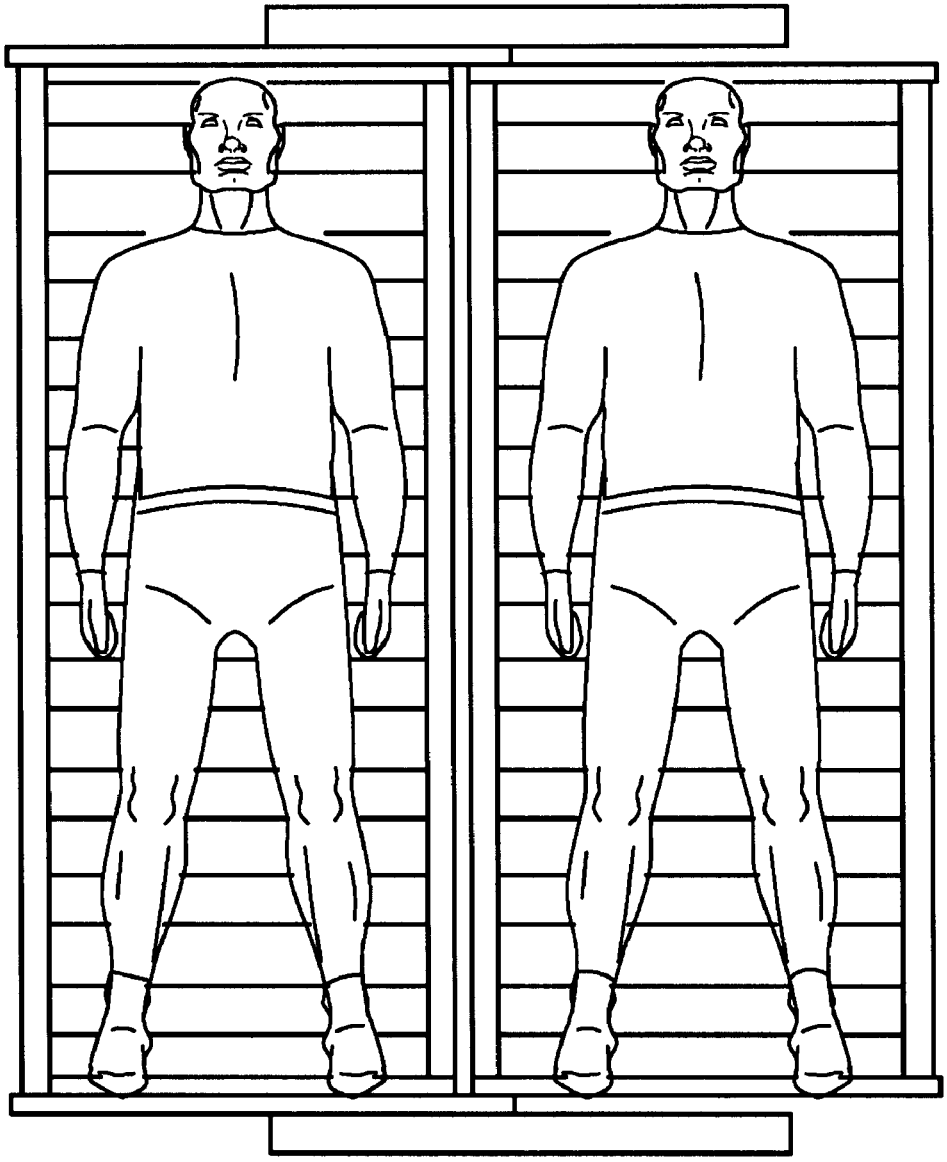
FIG. 2 illustrates the typical orientation of person(s) lying on a bi-fold futon bed-frame.
Figure 4:
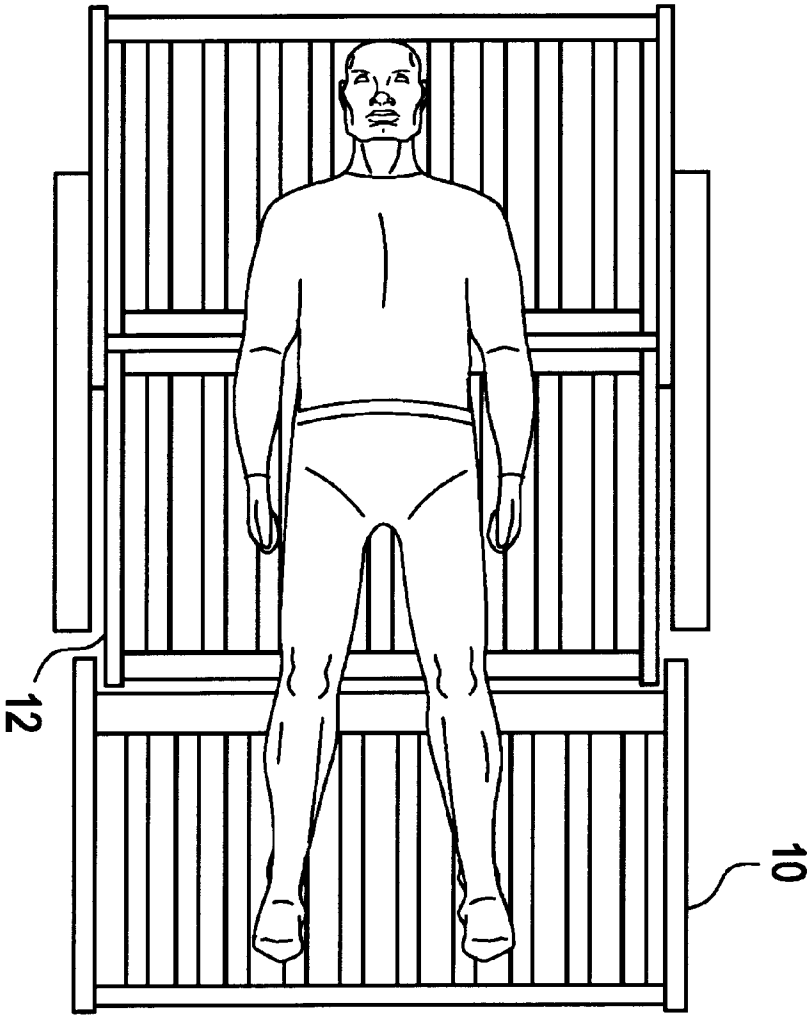
FIG. 4 illustrates the typical orientation of a person lying on a tri-fold futon bed-frame.
Figure 5A:
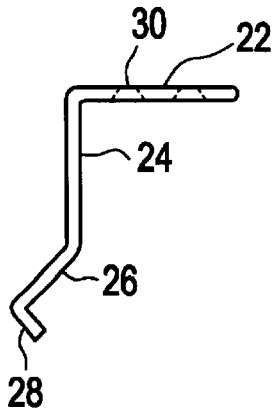
FIGS. 5*a*–5*d* illustrate the multi-angle hook in one exemplary embodiment of the present invention.
Figure 5B:
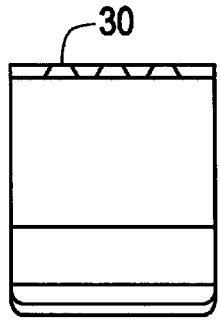
Figure 5D:
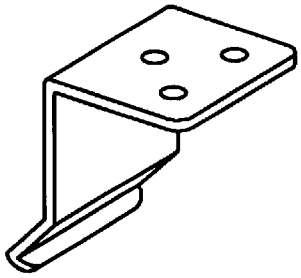
Figure 5C:
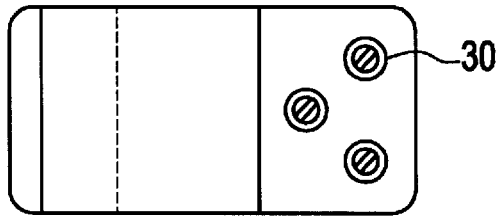

FIGS. 5*a*–5*d* illustrate the multi-angle hook 20 in one exemplary embodiment of the present invention. FIG. 5*a* illustrates a side view, FIG. 5*b* a front view, FIG. 5*c* a foldout view, and FIG. 5*d* an additional view. As illustrated in FIG. 5*a*, the multi-angle hook 20 includes a member 22 and a member 24, which, as shown, are at a right angle or substantially a right angle to each other, although this is not essential. In fact, the angle between members 24 and 26 can be any angle as long as the angle is capable of a portion of the seat platform 12, which will be discussed in more detail below with respect to FIGS. 6*a*–6*d*. The multi-angle hook 20 also includes a member 26 and a member 28. In a preferred embodiment, the multi-angle hook 20 is formed as a single piece, preferably of metal, but also possibly of any type of rigid, sturdy, plastic, wood or any other suitable material. As illustrated in FIGS. 5*a* and 5*d*, the angle between members 24 and 26 is obtuse, in particular, approximately 135° and the angle between members 26 and 28 is a right angle or substantially a right angle to each other, although these values are also not essential. In fact, similar to the angle between members 22 and 24, the angles between members 24 and 26 and members 26 and 28 can be any angle as long as the angles are capable of catching a portion of the seat platform 12, which will be discussed in more detail below with respect to FIGS. 6*a*–6*d*.

As illustrated in FIGS. 5*a*–5*d*, the multi-angle hook 20 includes at least one hole 30 for securing the multi-angle hook to the extension 10. In a preferred embodiment, the at least one hole 30 is counter-sunk. In another preferred embodiment, the number of holes 30 is three, although any number of holes may be used. Further, the manner in which the multi-angle hook 20 is secured to the extension 10, screws, bolts, nails, rivets, pins, staples, snaps, (or any other suitable fastener), glue (which might obviate the need for holes altogether), etc., is not significant, as long as the multi-angle hook 20 and the extension 10 are secured together.

Figure 6A:
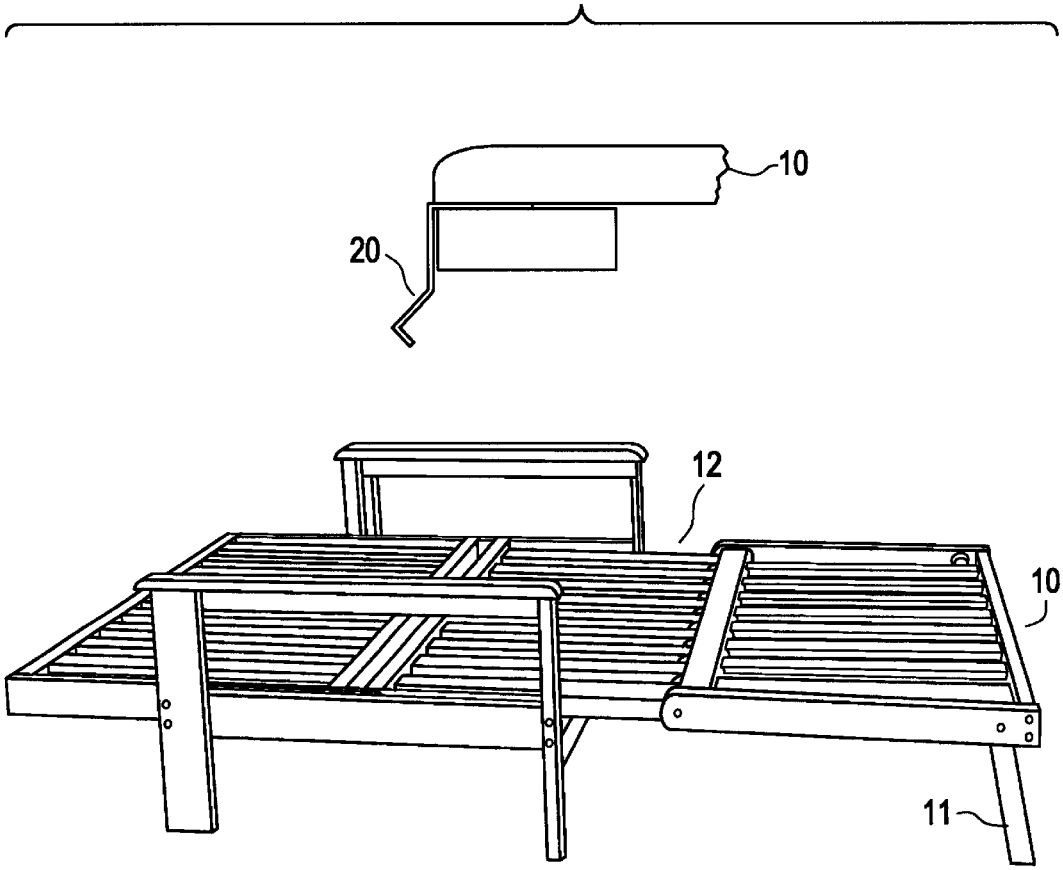
FIGS. 6*a*–6*d* illustrate the relationship between the extension, the seat platform, and the multi-angle hook of the present invention in several exemplary positions.

FIGS. 6*a*–6*d* illustrate the relationship between the extension 10, the seat platform 12, and the multi-angle hook 20 in several positions. FIG. 6*a* illustrates the bed position, where the extension 10 and the seat platform 12 are both substantially parallel to the floor. As illustrated in FIG. 6*a*, the multi-angle hook 20 is secured to the extension 10 and the multi-angle hook 20 is arranged such that it catches the seat platform 12. As illustrated, member 22 of the multi-angle hook 20 contacts and is substantially parallel to a top side of the seat platform 12 and member 24 of the multi-angle hook 20 contacts and is substantially parallel to a front side of the seat platform 12. In this manner, the extension 10 is supported by the seat platform 12 at one end and via legs 11 at the other end. Further, the multi-angle hook 20 enables the extension to temporarily engage the seat platform 12, when in the bed position.

Figure 6B:
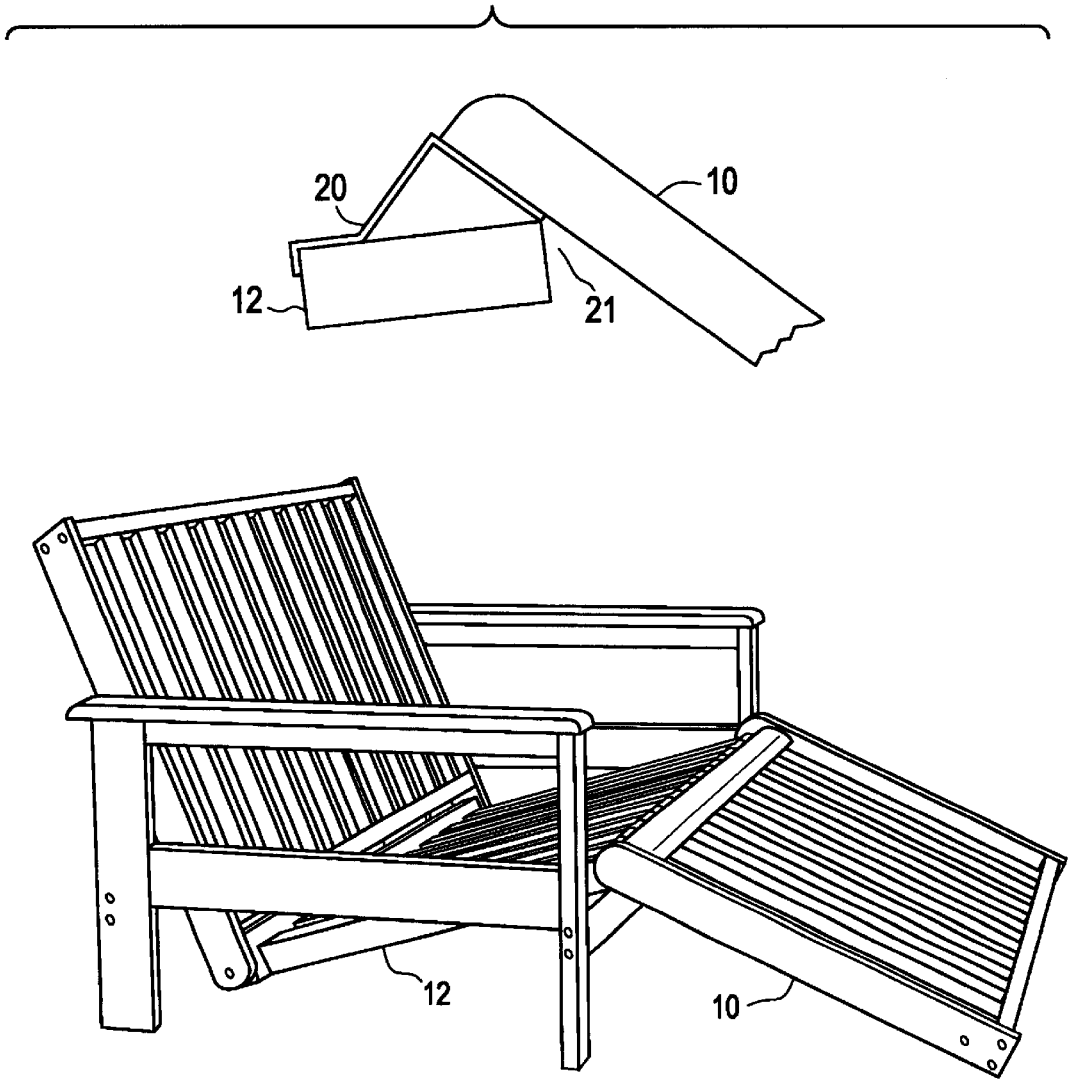
Figure 6C:
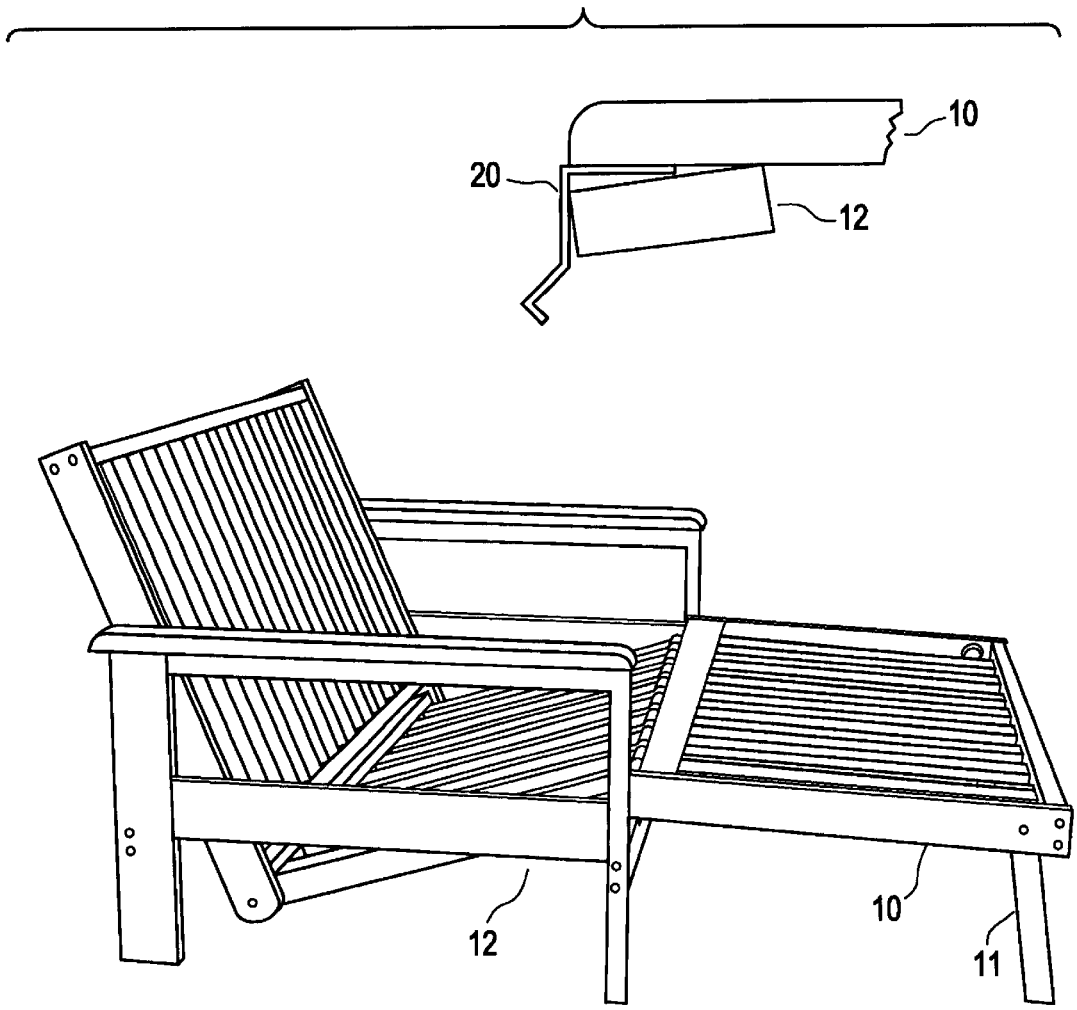

FIG. 6*b* illustrates the steamer position, where the extension 10 and the seat platform 12 are both substantially tilted with respect to the floor. As illustrated in FIG. 6*b*, the multi-angle hook 20 is secured to the extension 10 and the multi-angle hook 20 is arranged such that it again catches the seat platform 12. As illustrated, member 26 of the multi-angle hook 20 contacts and is substantially parallel to a top side of the seat platform 12 and member 28 of the multi-angle hook 20 contacts and is substantially parallel to a front side of the seat platform 12. In this manner, the extension 10 is supported by the seat platform 12 at one end and via the floor on the other end. Further, the multi-angle hook 20 enables the extension to temporarily engage the seat platform 12, when in the steamer position. It may also be advantageous for member 22 to have a notch or indent 21, at one end to further secure the seat platform 12. It is further noted that member 28 is optional FIG. 6*c* illustrates the lounger position, which is somewhat of a hybrid between the bed position and the steamer position in that the extension 10 may be parallel or substantially parallel to the floor as in the bed position (although the seat platform 12 is not) or the extension 10 may be tilted with respect to the floor, but less tilted than the seat platform 12 in the steamer position. As illustrated in FIG. 6*c*, the multi-angle hook 20 is secured to the extension 10 and the multi-angle hook 20 is arranged such that it again catches the seat platform 12. As illustrated, member 24 of the multi-angle hook 20 contacts the side of the seat platform 12 and member 22 and/or the extension 10 itself contact the top side of the seat platform 12. In this manner, the extension 10 is supported by the seat platform 12 at one end and via the legs 11 on the other end. Further, the multi-angle hook 20 enables the extension to temporarily engage the seat platform 12, when in the lounger position. It may also be advantageous for member 24 and/or member 22 (or the extension 10 itself) to have a notch or indent 21, to further secure the seat platform 12.

Figure 6D:
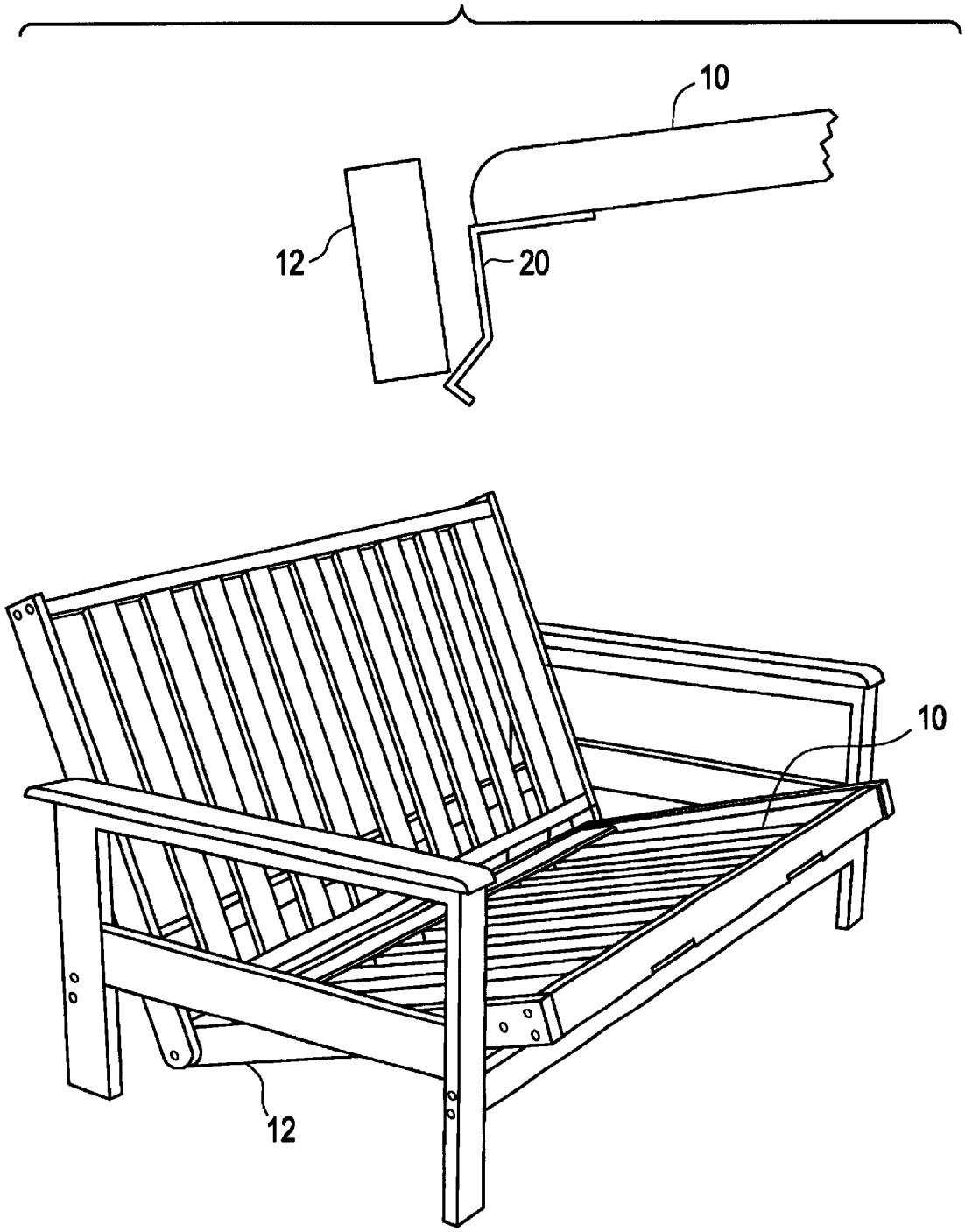

FIG. 6*d* illustrates the closed or unextended position, where the slats of the extension 10 are nested within the slats of the seat platform 12. The extension slats slide in between the slats of the seat platform 12, sliding in and out in relation to them. As illustrated in FIG. 6*d*, the extension 10 and the seat platform 12 are both substantially tilted with respect to the floor. As illustrated in FIG. 6*d*, the multi-angle hook 20 is arranged in front of a rear rail of the seat platform 12. As illustrated in FIG. 6*d*, there is little or no interaction between the multi-angle hook and the seat platform 12 in the closed or unextended position.

Figure 7A:
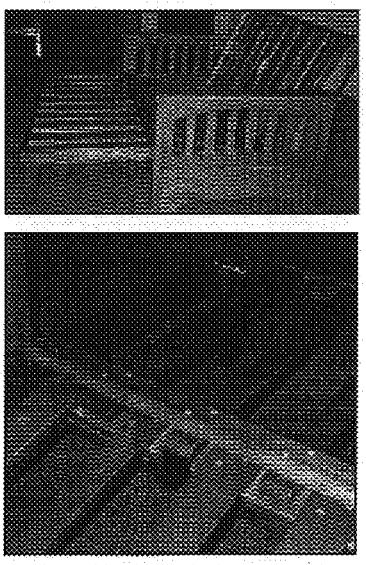
FIGS. 7*a*–7*c* illustrate the lounger position, the steamer position, and the bed position, respectively, from additional angles.
Figure 7B:
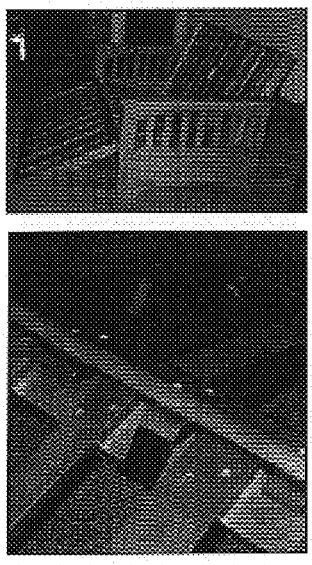
Figure 7C:
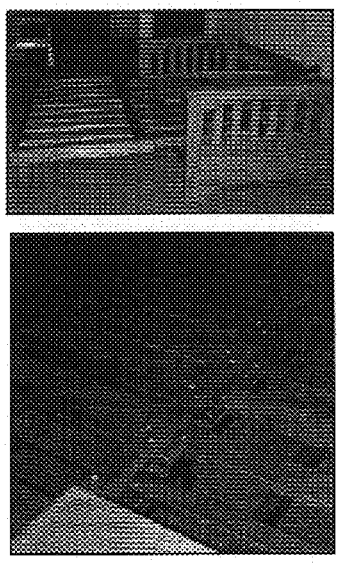

FIGS. 7*a*–7*c* illustrate the lounger position, the steamer position, and the bed position, respectively, from additional angles.

Although each of FIGS. 6*a*–6*d* and 7*a*–7*c* illustrate two multi-angle hooks, any number of hooks 20 may be utilized. Further, although the multi-angle hook 20 of FIGS. 6*a*–6*d* and 7*a*–7*c* contacts top and front sides of the front rail of the seat platform 12, the multi-angle hook 20 may contact any surface of the seat platform 12 or the extension 10 to accomplish the desired goal. Still further, although the multi-angle hook 20 of FIGS. 6*a*–6*d* and 7*a*–7*c* is shown as being attached to the extension 10, the multi-angle hook could also be attached to the seat platform 12. Still further, the multi-angle hook 20 may be configured so that in the lounger position, the extension 10 is inclined with respect to the floor (FIG. 6*c*) or parallel to the floor (FIG. 7*a*).

It is obvious from FIGS. 6*a* and 6*c* that member 28 is unnecessary in both the bed and lounger positions. It is less obvious that member 28 is also not necessary (although helpful) in the steamer position of FIG. 6*b*. The weight of the futon mattress can keep the multi-angle hook 20 in place in the steamer position. Accordingly, the inclusion of member 28 is considered desirable, but not necessary.

As described the present invention is directed to a multi-angle hook and a method of temporarily securing two frame components of a futon bed together. The multi-angle hook and method of temporarily securing two frame components of a futon bed together of the present invention changes the nature of the attachment two frame components of a futon bed by allowing easy and complete removal of one frame component from another. The multi-angle hook and method of temporarily securing two frame components of a futon bed together of the present invention allow one frame component to be freely lifted off another frame component and alternately lowered and set into place.

The multi-angle hook and method of temporarily securing two frame components of a futon bed together of the present invention facilitates conversion of the futon frame into its various positions (bed, steamer, lounger) because the futon frame is easier to manipulate with one or frame components removed. Further, defective parts are easily replaced using the multi-angle hook and method of temporarily securing two frame components of a futon bed together of the present invention. Still further, parts management in manufacturing is simpler using the multi-angle hook and method of temporarily securing two frame components of a futon bed together of the present invention, thereby saving production cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A multi-angle hook comprising at least three members, forming at least two different angles with respect to each other, so that different portions of said at least three members contact different portions of two frame components to removably secure the two frame components together, wherein one or both of the two frame components is not a billet;

wherein the two frame components are a futon extension and a futon seat platform.

2. The multi-angle hook of claim 1, wherein said at least three members are integral.

3. The multi-angle hook of claim 1, wherein said multi-angle hook is made of metal, plastic, or wood.

4. The multi-angle hook of claim 1, wherein said multi-angle hook is made of plastic.

5. The multi-angle hook of claim 1, wherein said at least three members include four members.

6. The multi-angle hook of claim 1, wherein said multi-angle hook is secured to the futon extension and at least one of the four members of the multi-angle hook contact a front rail of the futon seat platform.

7. The multi-angle hook of claim 6, wherein the futon extension and the futon seat platform may be placed in one of a bed position, steamer position and lounger position, depending on the placement of said multi-angle hook.

8. The multi-angle hook of claim 7, wherein in the bed position, at least one member of said multi-angle hook contacts and is substantially parallel to a top side of the futon seat platform and at least one member of said multi-angle hook contacts and is substantially parallel to a front side of the futon seat platform.

9. The multi-angle hook of claim 7, wherein in the steamer position, at least one member of said multi-angle hook contacts and is substantially parallel to a top side of the futon seat platform and at least one member of said multi-angle hook contacts and is substantially parallel to a front side of the futon seat platform.

10. The multi-angle hook of claim 7, wherein in the lounger position, at least one member of said multi-angle hook contacts the side of the futon seat platform and at least one member and/or the futon extension contact the top side of the futon seat platform.

11. The multi-angle hook of claim 1, wherein said multi-angle hook is secured to the futon extension by one of at least one nail, bolt, rivet, pin, staple, snap, or glue.

12. A multi-angle hook comprising at least four members, forming at least two different angles with respect to each other, so that different portions of said at least four members contact different portions of two frame components to removably secure the two frame components together, wherein two of said at least four members form a substantially right angle and two of said at least four members form an angle which is not substantially a right angle.

13. A frame component, comprising:

a body; and a multi-angle hook including at least three members, forming at least two different angles with respect to each other, so that different portions of said at least three members contact different portions of another frame component to removably secure the two frame components together, wherein one or both of the two frame components is not a billet;

wherein the two frame components are a futon extension and a futon seat platform.

14. The frame component of claim 13, wherein said multi-angle hook is secured to the body and at least one of the three members of the multi-angle hook contact a front rail of the futon seat platform.

15. The frame component of claim 14, wherein the futon extension and the futon seat platform may be placed in one of a bed position, steamer position and lounger position, depending on the placement of said multi-angle hook.

16. The frame component hook of claim 13, wherein said multi-angle hook is secured to the body by one of at least one nail, bolt, rivet, pin, staple, snap or glue.

17. A frame component, comprising:

a body; and a multi-angle hook including at least three members, forming at least two different angles with respect to each other, so that different portions of said at least three members contact different portions of another frame component to removably secure the two frame components together, wherein the two frame components are a futon extension and a futon seat platform, wherein said multi-angle hook is secured to the body and at least one of the three members of the multi-angle hook contact a front rail of the futon seat platform, wherein the futon extension and the futon seat platform may be placed in one of a bed position, steamer position and lounger position, depending on the placement of said multi-angle hook, wherein in the bed position, at least one member of said multi-angle hook contacts and is substantially parallel to a top side of the futon seat platform and at least one member of said multi-angle hook contacts and is substantially parallel to a front side of the futon seat platform.

18. A frame component, comprising:

a body; and a multi-angle hook including at least three members, forming at least two different angles with respect to each other, so that different portions of said at least three members contact different portions of another frame component to removably secure the two frame components together, wherein the two frame components are a futon extension and a futon seat platform, wherein said multi-angle hook is secured to the body and at least one of the three members of the multi-angle hook contact a front rail of the futon seat platform, wherein the futon extension and the futon seat platform may be placed in one of a bed position, steamer position and lounger position, depending on the placement of said multi-angle hook, wherein in the steamer position, at least one member of said multi-angle hook contacts and is substantially parallel to a top side of the futon seat platform and at least one member of said multi-angle hook contacts and is substantially parallel to a front side of the futon seat platform.

19. A frame component, comprising:

a body; and a multi-angle hook including at least three members, forming at least two different angles with respect to each other, so that different portions of said at least three members contact different portions of another frame component to removably secure the two frame components together, wherein the two frame components are a futon extension and a futon seat platform, wherein said multi-angle hook is secured to the body and at least one of the three members of the multi-angle hook contact a front rail of the futon seat platform, wherein the futon extension and the futon seat platform may be placed in one of a bed position, steamer position and lounger position, depending on the placement of said multi-angle hook, wherein in the lounger position, at least one member of said multi-angle hook contacts the side of the futon seat platform and at least one member and/or the futon extension contact the top side of the futon seat platform.

20. A futon frame, comprising:

at least two frame components; and a multi-angle hook including at least three members, forming at least two different angles with respect to each other, so that different portions of said at least three members contact different portions of two frame components to removably secure the at least two frame components together, wherein one or both of the two frame components is not a billet;

wherein the two frame components are a futon extension and a futon seat platform.

21. The futon frame of claim 20, wherein said multi-angle hook is secured to one of the at least two frame components and at least one of the three members of the multi-angle hook contact a front rail of the futon seat platform.

22. The futon frame of claim 21, wherein the futon extension and the futon seat platform may be placed in one of a bed position, steamer position and lounger position, depending on the placement of said multi-angle hook.

23. The futon frame of claim 20, wherein said multi-angle hook is secured to one of the at least two frame components by one of at least one nail, bolt, screw, rivet, pin, staple, snap, or glue.

24. A futon frame, comprising:

at least two frame components; and a multi-angle hook including at least three members, forming at least two different angles with respect to each other, so that different portions of said at least three members contact different portions of two frame components to removably secure the at least two frame components together, wherein the at least two frame components are a futon extension and a futon seat platform, wherein said multi-angle hook is secured to one of the at least two frame components and at least one of the three members of the multi-angle hook contact a front rail of the futon seat platform, wherein the futon extension and the futon seat platform may be placed in one of a bed position, steamer position and lounger position, depending on the placement of said multi-angle hook, wherein in the bed position, at least one member of said multi-angle hook contacts and is substantially parallel to a top side of the futon seat platform and at least one member of said multi-angle hook contacts and is substantially parallel to a front side of the futon seat platform.

25. A futon frame, comprising:

at least two frame components; and a multi-angle hook including at least three members, forming at least two different angles with respect to each other, so that different portions of said at least three members contact different portions of two frame components to removably secure the at least two frame components together, wherein the at least two frame components are a futon extension and a futon seat platform, wherein said multi-angle hook is secured to one of the at least two frame components and at least one of the three members of the multi-angle hook contact a front rail of the futon seat platform wherein the futon extension and the futon seat platform may be placed in one of a bed position, steamer position and lounger position, depending on the placement of said multi-angle hook, wherein in the steamer position, at least one member of said multi-angle hook contacts and is substantially parallel to a top side of the futon seat platform and at least one member of said multi-angle hook contacts and is substantially parallel to a front side of the futon seat platform.

26. A futon frame, comprising:

at least two frame components; and a multi-angle hook including at least three members, forming at least two different angles with respect to each other, so that different portions of said at least three members contact different portions of two frame components to removably secure the at least two frame components together, wherein the at least two frame components are a futon extension and a futon seat platform, wherein said multi-angle hook is secured to one of the at least two frame components and at least one of the three members of the multi-angle hook contact a front rail of the futon seat platform, wherein the futon extension and the futon seat platform may be placed in one of a bed position, steamer position and lounger position, depending on the placement of said multi-angle hook, wherein in the lounger position, at least one member of said multi-angle hook contacts the side of the futon seat platform and at least one member and/or the futon extension contact the top side of the futon seat platform.

27. A method of securing two frame components of a futon bed together, wherein one or both of the two frame components is not a billet, comprising:

providing the two frame components, wherein the two frame components are a futon extension and a futon seat platform;

wherein one of the two frame components has a multi-angle hook including at least three members, forming at least two different angles with respect to each other;

arranging the two frame components including the multi-angle hook so that so that different portions of the at least three members contact different portions of two frame components to removably secure the two frame components together.

28. The method of claim 27, wherein said multi-angle hook is secured to one of the two frame components and at least one of the three members of the multi-angle hook contact a front rail of the futon seat platform.

29. The method of claim 28, wherein the futon extension and the futon seat platform may be placed in one of a bed position, steamer position and lounger position, depending on the placement of said multi-angle hook.

30. The method of claim 27, wherein said multi-angle hook is secured to one of the two frame components by one of at least one nail, bolt, screw, rivet, pin, staple, snap, or glue.

31. A method of securing two frame components of a futon bed together, comprising:

providing the two frame components, wherein one of the two frame components has a multi-angle hook including at least three members, forming at least two different angles with respect to each other;

arranging the two frame components including the multi-angle hook so that so that different portions of the at least three members contact different portions of two frame components to removably secure the two frame components together, wherein the at least two frame components include a futon extension and a futon seat platform, wherein said multi-angle hook is secured to one of the two frame components and at least one of the three members of the multi-angle hook contact a front rail of the futon seat platform, wherein the futon extension and the futon seat platform may be placed in one of a bed position, steamer position and lounger position, depending on the placement of said multi-angle hook, wherein in the bed position, at least one member of said multi-angle hook contacts and is substantially parallel to a top side of the futon seat platform and at least one member of said multi-angle hook contacts and is substantially parallel to a front side of the futon seat platform.

32. A method of securing two frame components of a futon bed together, comprising:

providing the two frame components, wherein one of the two frame components has a multi-angle hook including at least three members, forming at least two different angles with respect to each other;

arranging the two frame components including the multi-angle hook so that so that different portions of the at least three members contact different portions of two frame components to removably secure the two frame components together, wherein the at least two frame components include a futon extension and a futon seat platform, wherein said multi-angle hook is secured to one of the two frame components and at least one of the three members of the multi-angle hook contact a front rail of the futon seat platform, wherein the futon extension and the futon seat platform may be placed in one of a bed position, steamer position and lounger position, depending on the placement of said multi-angle hook, wherein in the steamer position, at least one member of said multi-angle hook contacts and is substantially parallel to a top side of the futon seat platform and at least one member of said multi-angle hook contacts and is substantially parallel to a front side of the futon seat platform.

33. A method of securing two frame components of a futon bed together, comprising:

providing the two frame components, wherein one of the two frame components has a multi-angle hook including at least three members, forming at least two different angles with respect to each other;

arranging the two frame components including the multi-angle hook so that so that different portions of the at least three members contact different portions of two frame components to removably secure the two frame components together, wherein the at least two frame components include a futon extension and a futon seat platform, wherein said multi-angle hook is secured to one of the two frame components and at least one of the three members of the multi-angle hook contact a front rail of the futon seat platform, wherein the futon extension and the futon seat platform may be placed in one of a bed position, steamer position and lounger position, depending on the placement of said multi-angle hook, wherein in the lounger position, at least one member of said multi-angle hook contacts the side of the futon seat platform and at least one member and/or the futon extension contact the top side of the futon seat platform.

34. A frame component, comprising:

a body; and a multi-angle hook including at least four members, forming at least two different angles with respect to each other, so that different portions of said at least four members contact different portions of another frame component to removably secure the two frame components together, wherein two of said at least four members form a substantially right angle and two of said at least four members form an angle which is not substantially a right angle.

35. A futon frame, comprising:

at least two frame components; and a multi-angle hook including at least four members, forming at least two different angles with respect to each other, so that different portions of said at least four members contact different portions of two frame components to removably secure the at least two frame components together, wherein two of said at least four members form a substantially right angle and two of said at least four members form an angle which is not substantially a right angle.

36. A method of securing two frame components of a futon bed together, comprising:

providing the two frame components, wherein one of the two frame components has a multi-angle hook including at least four members, forming at least two different angles with respect to each other; and arranging the two frame components including the multi-angle hook so that so that different portions of the at least four members contact different portions of two frame components to removably secure the two frame components together, wherein two of said at least four members form a substantially right angle and two of said at least four members form an angle which is not substantially a right angle.

* * * * *

UNITED STATES PATENT AND TRADEMARK OFFICE

CERTIFICATE OF CORRECTION

PATENT NO. : 6,807,693 B2
DATED : October 26, 2004
INVENTOR(S) : Joel Grossman

It is certified that error appears in the above-identified patent and that said Letters Patent is hereby corrected as shown below:

Title page,
Item [73], Assignee, change "Grossman Project Services Sdn. Bhd." to -- Grossman Product Services Sdn. Bhd. --

Signed and Sealed this

Twenty-sixth Day of April, 2005

JON W. DUDAS
*Director of the United States Patent and Trademark Office*